US008801287B2

(12) United States Patent
Schinasi et al.

(10) Patent No.: US 8,801,287 B2
(45) Date of Patent: Aug. 12, 2014

(54) PROTECTIVE DEVICE FOR A DRAINING VALVE FITTED ON BAGS INTENDED FOR THE TRANSPORT AND HANDLING OF LIQUID OR QUASI-LIQUID SUBSTANCES

(75) Inventors: Piero Schinasi, Chemin de la Girarde (CH); Stéphane Levy, Avenue des Mousquines (CH)

(73) Assignee: Codefine S.A., Lausanne (CH)

( * ) Notice: Subject to any disclaimer, the term of this patent is extended or adjusted under 35 U.S.C. 154(b) by 412 days.

(21) Appl. No.: 13/380,106

(22) PCT Filed: Jun. 18, 2010

(86) PCT No.: PCT/IB2010/052764

§ 371 (c)(1),
(2), (4) Date: Dec. 22, 2011

(87) PCT Pub. No.: WO2010/150160

PCT Pub. Date: Dec. 29, 2010

(65) Prior Publication Data

US 2012/0099809 A1 Apr. 26, 2012

(30) Foreign Application Priority Data

Jun. 22, 2009 (CH) ..... 0967/09

(51) Int. Cl.
*B65D 33/02* (2006.01)
*B65D 33/16* (2006.01)

(52) U.S. Cl.
USPC ..... 383/119; 383/66; 383/906

(58) Field of Classification Search
CPC ..... B65D 88/1625; B65D 88/1631; B65D 88/1668; B65D 2588/165; B65D 19/06
USPC ..... 383/119, 66, 38–40, 906
See application file for complete search history.

(56) References Cited

U.S. PATENT DOCUMENTS

2005/0196080 A1 9/2005 Stone

FOREIGN PATENT DOCUMENTS

WO WO 97/20758 A1 6/1997
WO WO 2009/010928 A2 1/2009

*Primary Examiner* — Jes F Pascua
(74) *Attorney, Agent, or Firm* — Krieg DeVault LLP; Clifford W. Browning

(57) ABSTRACT

The invention relates to a protective device (10) for a drainage valve (27) fitted to bags or "bags in boxes" intended for the transport and handling of liquid or quasi-liquid substances, said device (10) being formed by a sheet (1) of flexible material folded in on itself, two parallel side edges of said sheet being fixed to one another over at least a part of their length so as to form an approximately rectangular envelope which is open on one of its sides, called the insertion side, into which a reinforcing panel (30) located on the side of the bag and provided with the drainage valve (27) is inserted, said panel (30) having a thickness e1 and being provided with a hole (T) for said drainage valve (27) to pass through. The envelope has at least one opening (4) on its front and/or rear side for the drainage valve (27) to pass through, and at least one closed compartment (5A, 5B, 5C) containing flexible material, said compartment causing an overthickness e2 at the surface of the envelope, such that the sum of e1 and e2 is approximately equal to or greater than the height H of the drainage valve (27).

10 Claims, 2 Drawing Sheets

PROTECTIVE DEVICE FOR A DRAINING VALVE FITTED ON BAGS INTENDED FOR THE TRANSPORT AND HANDLING OF LIQUID OR QUASI-LIQUID SUBSTANCES

This application claims the benefits under 35 U.S.C. 119 (a)-(d) or (b), or 365(b) of International Application No. PCT/IB2010/052764, filed 18 Jun. 2010, and Swiss Patent Application No. CH00967/09, filed 22 Jun. 2009.

TECHNICAL FIELD

The present invention relates to a protective device for a draining valve fitted on bags intended for the transport and handling of liquid or quasi-liquid substances. The bags for which the device of the present invention is particularly suitable are generally called "big bags" or "bags in box" in industry and in the transportation sector owing to the fact that they are intended to transport a volume of product of the order of one cubic meter or even more and that they weigh one ton or more once filled.

PRIOR ART

"Bags in box" generally have an outer envelope stiffened by various materials and an inner envelope formed by a film ensuring the impermeability of the device. Such "bag in boxes" were the subject, in particular, of the international patent application WO 2009/010928 filed in the name of the Applicant. The person skilled in the art will find it useful to refer thereto to obtain possible additional information on this matter.

In this type of bag it is necessary to provide a filling and draining device which is often in the form of a valve integrated in the impermeable inner film of the bag, or "liner". The disadvantage of this type of valve is the positioning thereof on the outside of the bag. Thus it forms a protrusion on the outer walls of the bag. This position proves to be particularly troublesome during formation and handling of the bag.

In particular, it is necessary to provide a passage for the said valve in the reinforcing panel fitted to the side of the bag where the said valve is positioned in a protruding manner. This passage can consist in particular of a hole pierced or cut through the reinforcing panel, the form and positioning of the said hole on the reinforcing panel being directly dependent on the form and placement of the said valve on the inner wall of the bag disposed facing the reinforcing panel. In the most common case, the valve being in the form of a circular disc with a height of 6 to 8 cm, and being positioned in the lower part of the bag, the hole formed in the reinforcing panel will be of a circular shape with a diameter slightly greater than that of the valve and will be positioned in the lower part of the panel. However, it should be noted that, in spite of the presence of this reinforcing panel, a not inconsiderable part of the valve protrudes from the panel and forms a protrusion on the outside of the bag. In fact, the panels used to reinforce the bags covered by the present invention are generally of a thickness of not greater than 2 cm and frequently of a thickness of around 1 cm. As previously seen, this proves insufficient to cover the full height of a conventional valve.

This protruding position of the valve in fact causes a major disadvantage when this type of bag is being handled. In fact, the transport apparatuses which handle this type of bag during loading or unloading can accidently catch the said valve and thus cause the inner wall of the bag on which the said valve was attached to be torn. This tearing inevitably causes a leakage of the liquid or quasi-liquid product contained in the bag, with as a direct consequence the loss of the spilled product and a detrimental effect on the surroundings.

DISCLOSURE OF THE INVENTION

It is thus necessary to provide a simple and effective solution to this problem while avoiding completely modifying the structure of the bag as a whole.

A first conceivable solution would have been to use a thicker reinforcing panel to completely cover the height of the valve and thus protect against impact. This panel would have been placed in place of the panel usually used in this type of bag or as a complement to the said panel so as to form an additional layer of protection around the valve and thus avoid any damage to the valve by the transport apparatuses. However, this solution is to be rejected for two major reasons. On the one hand, by making provision to add an additional panel thickness, there is a risk of causing tearing of the inner or outer fabric of the bag which covers the said panel. This risk is all the greater when the material forming this type of panel is rigid and non-deformable. The panels being substantially rectangular parallelepipeds provided with acutely angled corners, tearing of the fabric at these corners is almost certain to occur. On the other hand, the addition of an additional rigid panel on the inside of the bags would incur costs which are too high for the user.

The object of the present invention is thus to propose a simple and not very expensive solution to the problem mentioned above and not presenting the disadvantages of the previously described solution.

To this end, in accordance with the invention, there is proposed a protective device for a draining valve fitted to the bags intended for the transport and handling of liquid or quasi-liquid substances, the said device being formed by a sheet of flexible material folded on itself, two parallel lateral edges of the said sheet being fixed to one another on at least a part of their length so as to form a substantially rectangular envelope open on only one of its sides, called the introduction side, into which a reinforcing panel disposed on the side of the bag provided with the draining valve is inserted, the said panel having a thickness e1 and being provided with a hole permitting passage of the said draining valve, characterised in that the envelope has at least one opening on its front side and/or its rear side permitting the passage of the draining valve and at least one closed compartment containing flexible material, the said compartment creating an over-thickness e2 on the surface of the envelope, so that the sum of e1 and e2 is substantially equal to or greater than the height H of the draining valve.

In one advantageous configuration of the invention, the flexible material contained in the closed compartment(s) of the envelope is identical to the flexible material used to form the sheet defining the envelope.

In one particular configuration of the invention the sheet defining the envelope is made of polypropylene.

In one particular configuration of the invention, the sheet defining the envelope is itself formed by a base sheet of flexible material being folded on itself, the edges of which have been fixed together, in particular by welding.

In another particular configuration of the invention, the closed compartment(s) are disposed around the opening permitting the passage of the draining valve.

In another particular configuration of the invention, the envelope has exactly three closed rectangular compartments disposed so as to form an additional compartment in the envelope, the said additional compartment being of a square shape and being pierced in its centre by the opening serving for passage of the draining valve.

In another particular configuration of the invention, the sides of the envelope, except for the introduction side, are formed by welding the lateral edges of the sheet defining the envelope.

Another object of the present invention also relates to a bag intended for transporting and handling liquid or quasi-liquid substances, the said bag having a draining valve forming a protrusion with respect to one of its sides and a reinforcing panel covering the said side at least partially, characterised in that a lower end of the said reinforcing panel is covered by a protective device as defined above, so as to protect the draining valve from impacts owing to transportation.

In one particular configuration of the bag, the device for protecting the draining valve is disposed so that the closed compartments of the envelope are oriented towards the outside of the bag.

In another particular configuration of the bag, the device for protecting the draining valve is disposed so that the closed compartments of the envelope are oriented towards the inside of the bag.

Thus configured, the protective device of the present invention makes possible total coverage of the draining valve, the impacts caused during transportation of the bag being attenuated, or even eliminated, by the deformable closed compartments, filled with flexible material, of the protective device.

The risk of the outer or inner fabric of the bag being pierced is also avoided because the material used to form the protective device of the present invention is flexible and deformable and because there is no sharp corner on the periphery of the said device.

BRIEF DESCRIPTION OF THE DRAWINGS

Other advantages and features of the present invention will be better understood on reading of a particular embodiment of the invention and with reference to the drawings in which.

DETAILED DESCRIPTION OF AN EMBODIMENT OF THE INVENTION

Figure 1:
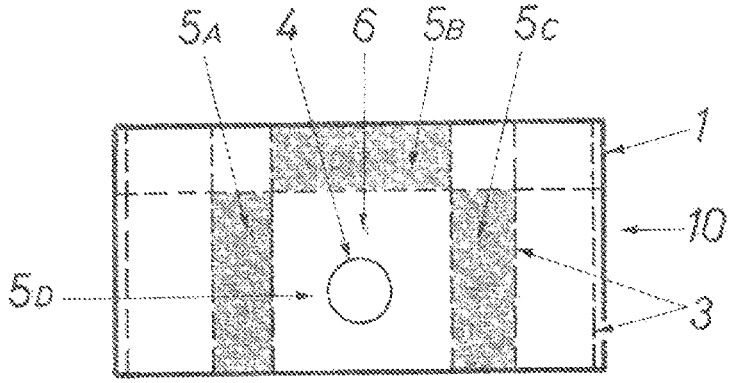
FIG. 1 shows a front view of the front face of a protective device in accordance with the invention.
Figure 2:
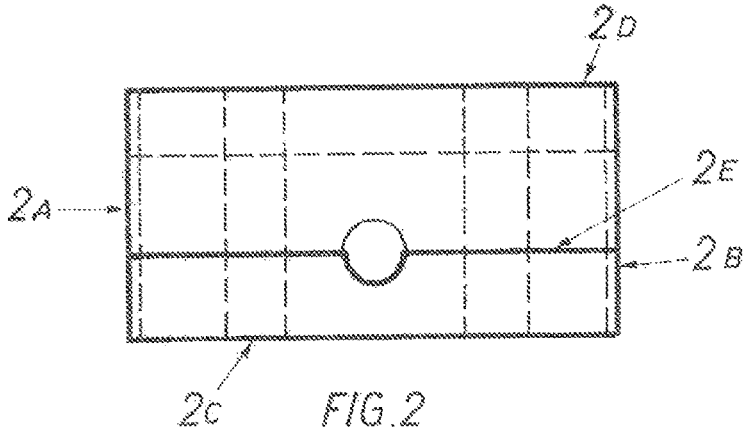
FIG. 2 shows a front view of the rear face of the device illustrated in FIG. 1.

FIG. 1 shows a device for protecting a draining valve in accordance with the invention. This protective device 10 is formed by a sheet 1 folded on itself so as to form a substantially rectangular envelope defined by its lateral edges 2A, 2B and longitudinal edges 2C and 2D (see FIG. 2). It is conceivable not to cause the lower and upper edges of the sheet 1 to coincide when it is being folded, the envelope then having an additional longitudinal edge 2E (see FIG. 2) disposed between the edges 2C and 2D. The lateral edges 2A and 2B will be fixed to each other by means of a chosen fixing method selected in particular from welding, sewing and gluing. The edges 2D and 2E which remained free make it possible to insert a reinforcing panel into the pocket defined at the bottom by the edge 2C and on the sides by the edges 2A and 2B. It will be advantageous to choose a width for the sheet 1 substantially equal to, even slightly greater than, the width of the reinforcing panel so as to ensure that the protective envelope 10 is easily held around the panel without having to provide additional fixing means.

In order to permit passage of the draining valve to be protected, the device 10 is pierced through by a substantially circular opening 4, the diameter of the opening 4 being slightly greater than that of the draining valve. This form of opening proves particularly suitable for positioning the device 10 precisely with respect to the valve and thus avoiding a possible displacement of the device 10 during handling of the bag. Such a displacement would in fact risk a decrease in the protection of the draining valve.

In the preferred configuration of the invention, the sheet 1 is formed by a flexible material such as polypropylene. Of course, it will be possible to use any other type of flexible materials other than polypropylene. Furthermore, the sheet 1 is advantageously formed by superimposing two base sheets of the same format, made of flexible material and connected to each other by their edge, or is formed by a base sheet of flexible material folded on itself and having its edges fixed to each other. The sheet 1 thus has an internal empty space which can enable lining elements intended to increase the thickness of the said sheet 1 to be housed. These lining elements can advantageously be formed by pieces of flexible material sheeting. It goes without saying that any other flexible and deformable material can be used as a lining element instead of or in addition to these pieces of sheeting. The internal empty space of the sheet 1 can also be divided into compartments closed by means of weld lines 3. These weld lines 3 in fact connect the front and rear faces of the sheet 1. It is evident that other known fixing methods can be used in place of welding to form these front/rear connections.

As shown in FIG. 1, such weld lines 3 have made it possible to define three closed compartments 5A, 5B and 5C. These rectangular closed compartments are distributed around the opening 4 so as to form an additional compartment 5D in the envelope, the said additional compartment 5D being square in shape and being pierced in its centre by the opening 4 serving as a passage for the draining valve. This arrangement of the compartments is advantageous in that it makes possible a balanced distribution of the compression forces which could be exerted on the protective device 10 in particular following an impact caused during handling of the bag.

It goes without saying that other forms and arrangements of the compartments will be conceivable in place of the configuration illustrated in FIG. 1. In particular, it will be possible to increase or decrease the number of closed compartments or to modify the form and arrangement of the said compartments without departing from the scope of the invention.

Figure 3:
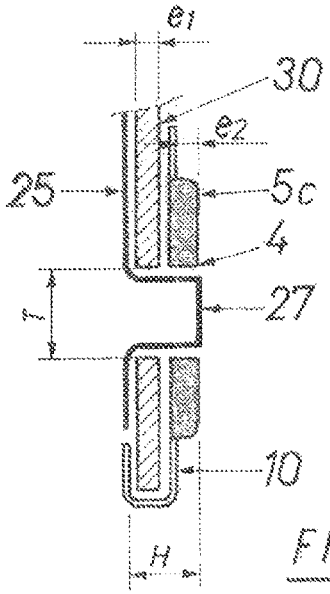
FIG. 3 shows a side view in cross-section of the protective device of FIG. 1 in its final usage position.

With reference to FIG. 3, there is shown a side view in cross-section of the protective device 10 of FIG. 1 once the reinforcing panel 30 has been slid inside the pocket formed by the device 10 and the draining valve 27 has been inserted inside the hole T in the reinforcing panel 30 and the opening 4 of the device 10. As shown in this figure, the draining valve 27 is fixedly attached to the inner envelope 25 of the bag containing the liquid or semi-liquid products. This figure enables us to see that the draining valve 27 is totally protected on the one hand by the reinforcing panel 30 and on the other hand by the protective device 10. It will be noted in particular that the length of the valve 27 protruding beyond the inner envelope 25 of the bag, so-called valve height H, corresponds substantially to the sum of the thickness e1 of the reinforcing panel 30 and the over-thickness e2 created by the compartments 5A, 5B and 5C on the surface of the sheet 1 forming the protective device 10. This obviously corresponds to a particular configuration of the invention. In the general case, it will be sufficient to choose the thickness e2 so that the sum of e1 and e2 is greater than, or equal to, the height H.

Figure 4:
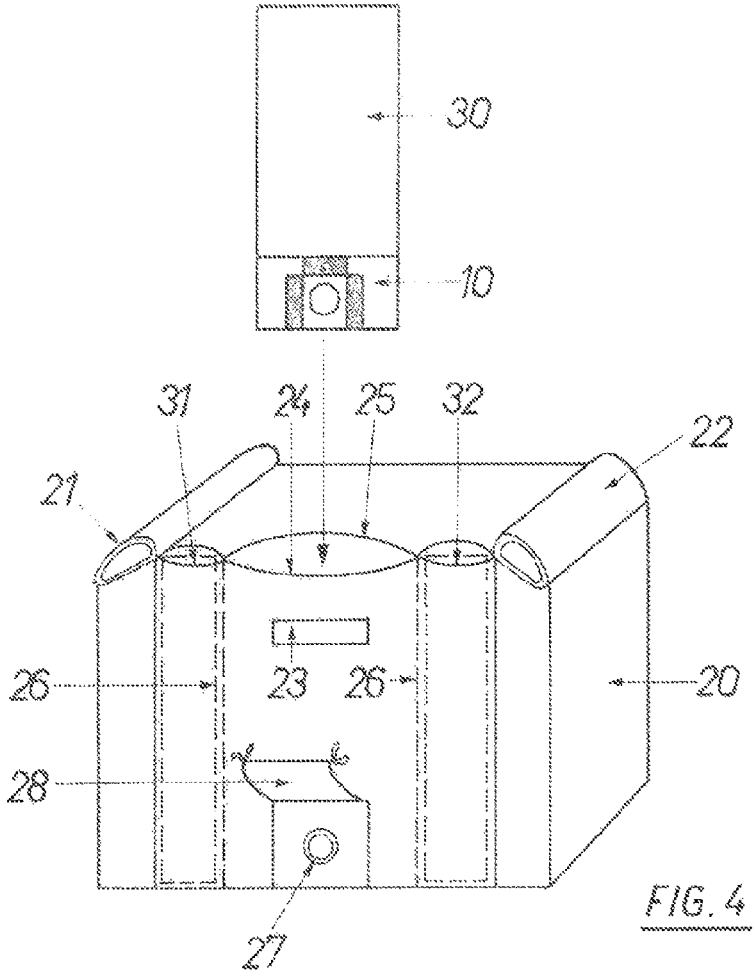
FIG. 4 shows a perspective view of a bag in accordance with the invention before introduction of the reinforcing panel provided with the protective device illustrated in FIG. 1.
Figure 5:
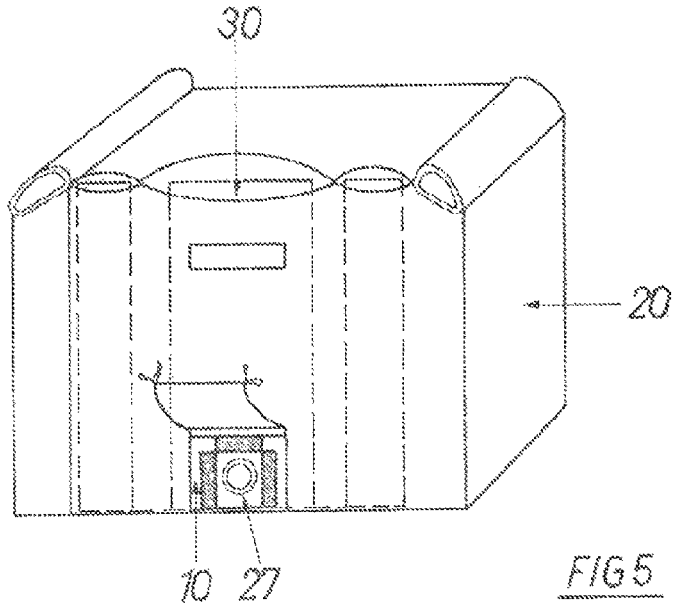
FIG. 5 shows a perspective view of the bag illustrated in FIG. 4, after introduction of the reinforcing panel provided with the protective device illustrated in FIG. 1.

With reference to FIGS. 4 and 5, we will now describe in more detail the placement of the device of the invention within a bag generally used to transport liquid or quasi-liquid substances. The bags of this type are loaded by means of a lifting truck, the arms of the truck engaging inside hollow tubes disposed on the top of the bag. In FIG. 4, the bag 20 is practically a cube, which is not in any way meant to be limiting. The four upper corners of the bag 20 are provided with a lifting belt 21, so that the bag as a whole is perfectly symmetrical. The bag 20 is also provided with connections produced by means of a piece of fabric 22 sewn on each of the two belts 21 forming a pair. The piece of fabric 22 thus forms a tube or conduit with the two lifting belts 21 of a single pair, the tube or conduit being intended to permit the engagement of the arms of the fork of a lifting truck. Furthermore, provision is made to equip at least one of the lateral sides of the bag 20 with a transport handle 23 so as to be able to displace it more easily when it is empty.

It is noted that the sides of the bag are produced in a double fabric. This double fabric can be formed either by joining two pieces of single fabric, or by using a tubular fabric folded in two, forming a flattened sleeve. This double fabric thus defines an outer envelope 24 and an inner envelope 25 for the bag 20. The double fabric is divided into three housings by producing two vertical seams 26 which extend over the whole height of the bag. Inside the three housings thus formed, reinforcing panels 30, 31 and 32 arc introduced. In the illustrated embodiment, the central housing is larger than the two lateral housings. The width of the central reinforcing panel 30 is approximately 30% greater than the width of the two lateral panels, the height of the three plates naturally being the same.

FIG. 4 shows the draining valve 27 protruding with respect to the inner envelope 25. A flap 28 cut into the outer envelope 24 allows access to the said valve 27 from the outside.

As illustrated in FIG. 5, the panel 30 provided with the protective device 10 completely covers the zone of the bag 20 surrounding the draining valve 27 so as to protect it from impacts owing to transportation. In the illustrated configuration, the reinforcing panel 30 is disposed so that the closed compartments of the protective device 10 are oriented towards the outside of the bag 20. However, it is conceivable to dispose it in the other direction so that the closed compartments are oriented towards the inside of the bag 20.

In practice, before filling the bag with liquid or quasi-liquid substances, care will be taken that the draining valve welded to the impermeable inner envelope of the bag is correctly introduced through the respective openings of the reinforcing panel and of the protective device. This precaution will make it possible to avoid the valve being positioned at a slant with respect to the axis of the said openings, which would subject the valve to significant shearing forces during handling of the bag and thus to a potential risk of rupturing the said valve. Furthermore, it is also possible that, during filling of the bag, the valve will be retracted inside the bag, the valve not being held at the openings. In this case, there is a great risk that the valve will be positioned offset with respect to the axis of the said openings and will be compressed as a result between the inner envelope of the bag and the adjacent reinforcing panel. In order to solve this problem, it will be advantageous to equip the free end of the valve with a protruding annular edge and to dispose on the valve—in particular by clip-fastening, in an intermediate position between the said annular edge and the protective device—a stop plate having a semi-circular cut-out, the diameter of which is substantially equal to the diameter of the valve. Thus it will be avoided that the valve is positioned retracted with respect to the plane defined by the reinforcing panel when the bag is being filled.

The invention claimed is:

1. Protective device for a draining valve fitted to the bags intended for the transport and handling of liquid or quasi-liquid substances, said device being formed by a sheet of flexible material folded on itself, two parallel lateral edges of said sheet being fixed to one another on at least a part of their length so as to form a substantially rectangular envelope open on only one of its sides, to form an introduction side, into which a reinforcing panel will be disposed on a side of the bag provided with the draining valve is inserted, said panel having a thickness and being provided with a hole permitting passage of said draining valve, wherein the envelope has at least one opening on at least one of its front side its rear side permitting the passage of the draining valve and at least one closed compartment containing flexible material, said compartment creating an over-thickness on the surface of the envelope, so that the sum of and is at least substantially equal to a height of the draining valve.

2. Protective device as claimed in claim 1, wherein the flexible material contained in said at least one closed compartment of the envelope is identical to the flexible material used to form the sheet defining the envelope.

3. Protective device as claimed in claim 1, wherein the sheet defining the envelope is made of polypropylene.

4. Protective device as claimed in claim 1, wherein the sheet defining the envelope is itself formed by a base sheet of flexible material being folded on itself, the edges of which have been fixed together.

5. Protective device as claimed in claim 1, wherein said at least on closed compartment is disposed around the opening permitting the passage of the draining valve.

6. Protective device as claimed in claim 5, wherein the envelope has exactly three closed rectangular compartments disposed so as to form an additional compartment in the envelope, said additional compartment being of a square shape and being pierced in its centre by the opening serving for passage of the draining valve.

7. Protective device as claimed in claim 1, wherein the sides of the envelope, except for the introduction side, are formed by welding the lateral edges of the sheet defining the envelope.

8. Bag intended for transporting and handling liquid or quasi-liquid substances, said bag having a draining valve forming a protrusion with respect to one of its sides and said reinforcing panel covering the side at least partially, wherein a lower end of said reinforcing panel is covered by said protective device as claimed in claim 1, so as to protect the draining valve from impacts owing to transportation.

9. Bag as claimed in claim 8, wherein the protective device of the draining valve is disposed so that the closed compartments of the envelope are oriented towards the outside of the bag.

10. Bag as claimed in claim 8, wherein the protective device of the draining valve is disposed so that the closed compartments of the envelope are oriented towards the inside of the bag.

* * * * *